US007841901B2

(12) United States Patent
Yu et al.

(10) Patent No.: US 7,841,901 B2
(45) Date of Patent: Nov. 30, 2010

(54) ELECTRICAL CONNECTOR ASSEMBLY WITH AN INTEGRATED CIRCUIT MODULE

(75) Inventors: Hsin-Hsien Yu, Tu-Cheng (TW); Shun-Jung Chuang, Tu-Cheng (TW); Chin-Sheng Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/750,589

(22) Filed: Mar. 30, 2010

(65) Prior Publication Data

US 2010/0248543 A1 Sep. 30, 2010

(30) Foreign Application Priority Data

Mar. 31, 2009 (TW) ..... 98205035 U

(51) Int. Cl.
*H01R 13/66* (2006.01)

(52) U.S. Cl. ..... 439/620.01; 439/620.12

(58) Field of Classification Search ..... 439/607.11, 439/607.4, 620.01, 906, 620.12
See application file for complete search history.

(56) References Cited

U.S. PATENT DOCUMENTS

| | | | | |
|---|---|---|---|---|
| 6,350,152 | B1 * | 2/2002 | Belopolsky et al. | 439/620.01 |
| 6,736,680 | B2 * | 5/2004 | Slack et al. | 439/620.26 |
| 7,682,172 | B2 * | 3/2010 | Lu | 439/620.13 |
| 2009/0023337 | A1 * | 1/2009 | Chang | 439/607 |
| 2009/0142946 | A1 | 6/2009 | Honhai | |

* cited by examiner

*Primary Examiner*—Tho D Ta
(74) *Attorney, Agent, or Firm*—Wei Te Chung; Andrew C. Cheng; Ming Chieh Chang

(57) ABSTRACT

An electrical connector assembly (100) with an integrated circuit module (4) comprises: an insulative housing (1) having a base portion (11) and a tongue portion (12) extending from the base portion (11); a number of contacts (2) assembled in a number of recesses (10) of the housing (1), each contact (2) having a contact portion (21) at the front end, a middle connecting portion (22), and a soldering tail (23) at the rear end; a shield case (3) enclosing the housing (1); and an integrated circuit module (4). The integrated circuit module (4) is soldered to the connecting portions of the contacts and therefore fastened by the electrical connector.

17 Claims, 10 Drawing Sheets

ELECTRICAL CONNECTOR ASSEMBLY WITH AN INTEGRATED CIRCUIT MODULE

BACKGROUND OF THE INVENTION

1. Field of the Invention

The present invention generally relates to an electrical connector, and more particularly to a electrical connector with an integrated circuit module.

2. Description of Related Arts

U.S. Patent Application No. 20090142946 discloses an electrical connector assembly with ESD protection. The electrical connector assembly comprises an insulative housing in which a number of contacts are retained. The contacts include a plurality of signal contacts and at least one grounding contact. Furthermore, the electrical connector assembly includes an electrostatic discharge device which electrically interconnects with the contact.

In the art of U.S. Patent Application No. 20090142946, the electrostatic discharge device is attached to an outside of the connector and therefore its stability needs to be improved.

Hence, an electrical connector assembly with an integrated circuit module mounted firmly is desired.

SUMMARY OF THE INVENTION

Accordingly, an object of the present invention is to provide an electrical connector assembly with an integrated circuit module mounted firmly.

To achieve the above object, electrical connector assembly with an integrated circuit module. An electrical connector assembly with an integrated circuit module comprising:

an insulative housing having a base portion and a tongue portion extending from said base portion;

a number of contacts assembled in a number of recesses placed in the housing, and each said contact having a contact portion at the front end, a connecting portion adjacent the contact portion, and a soldering tail at the rear end adjoin to the connecting portion;

a shield case enclosing said housing; and an integrated circuit module;

the integrated circuit module soldered to said connecting portion of the contacts.

As has been described above, the integrated circuit module is soldered to said connecting portion of the contacts. The integrated circuit module is fasten by the connector, so the stability of the integrated circuit module is improved.

Other objects, advantages and novel features of the invention will become more apparent from the following detailed description when taken in conjunction with the accompanying drawings.

DETAILED DESCRIPTION OF THE PREFERRED EMBODIMENT

Figure 1:
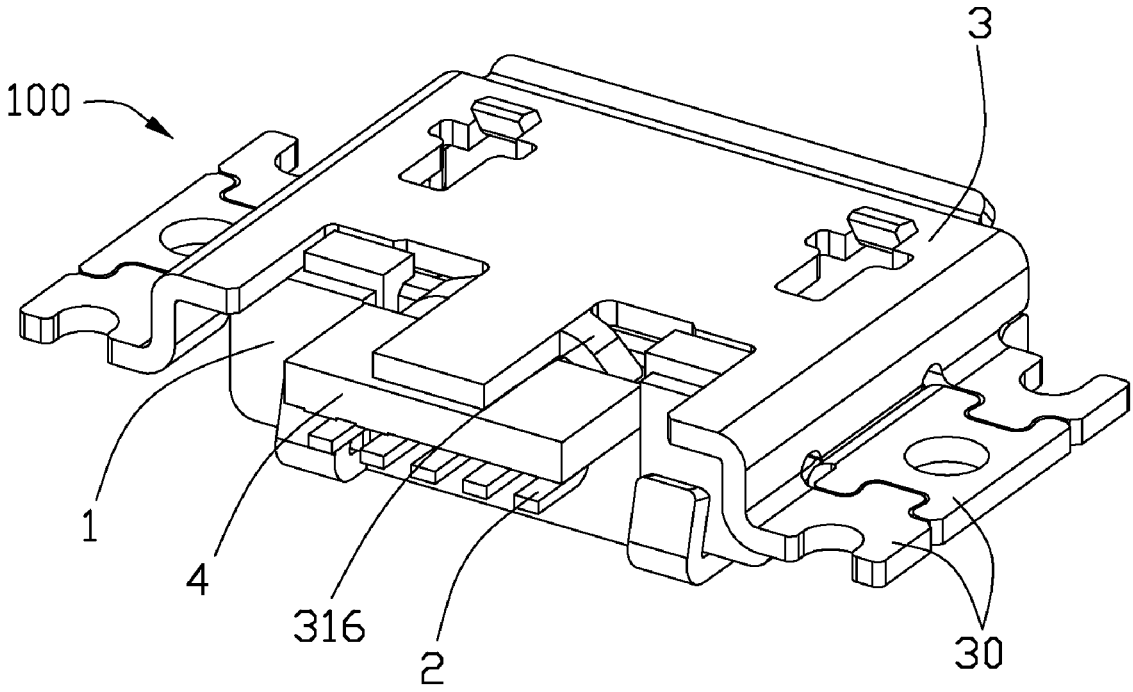
FIG. 1 is a perspective, assembled view of an electrical connector assembly according to a first embodiment of the present invention.
Figure 2:
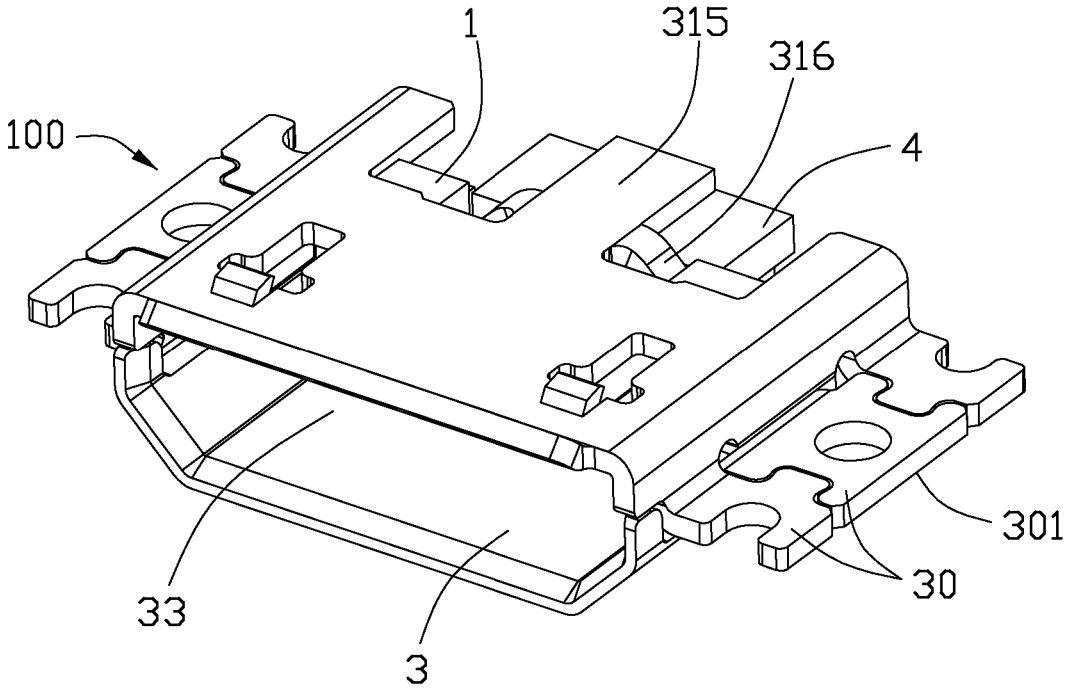
FIG. 2 is another perspective, assembled view of the electrical connector assembly of FIG. 1.
Figure 3:
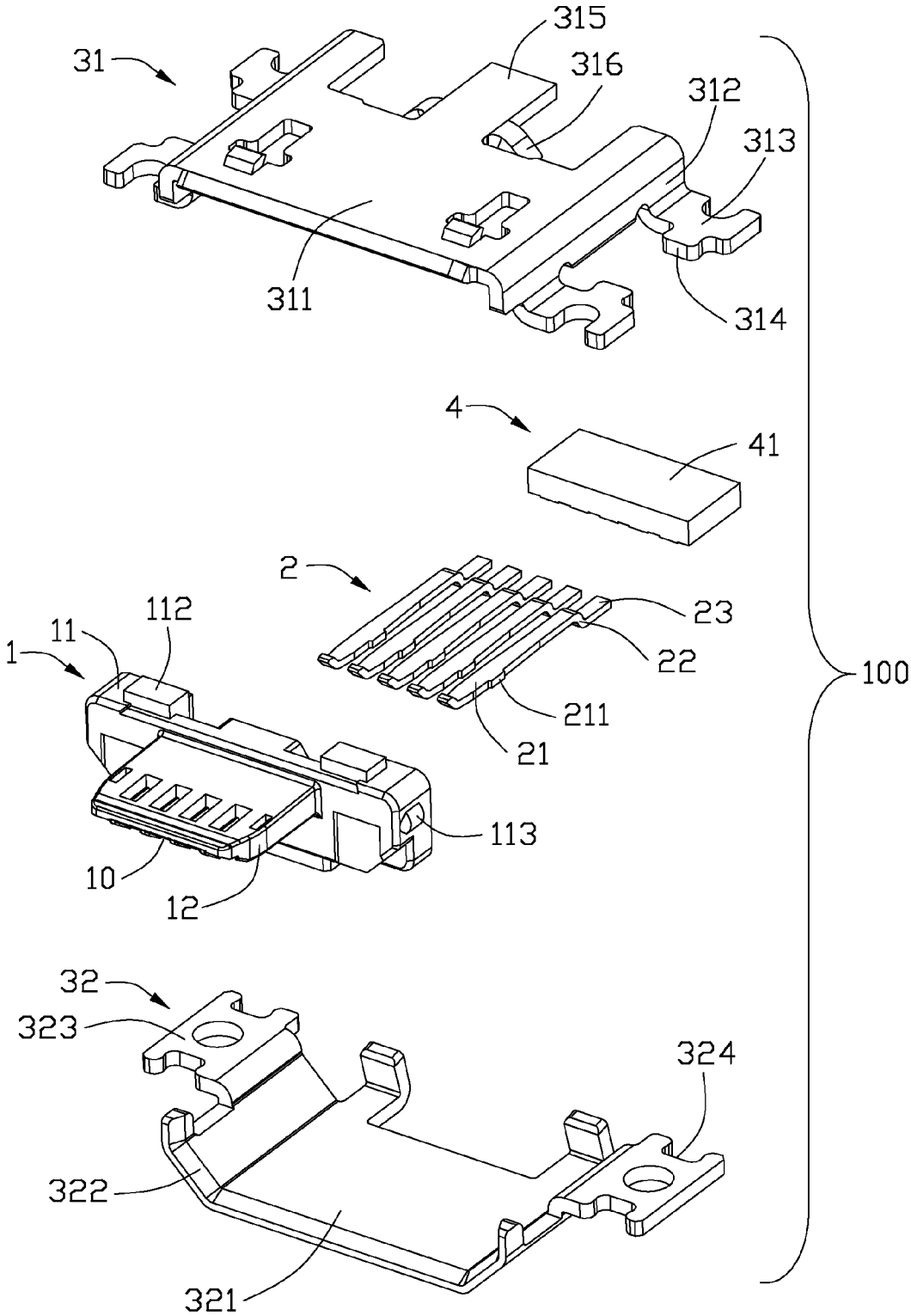
FIG. 3 is a perspective, exploded view of the electrical connector assembly.
Figure 4:
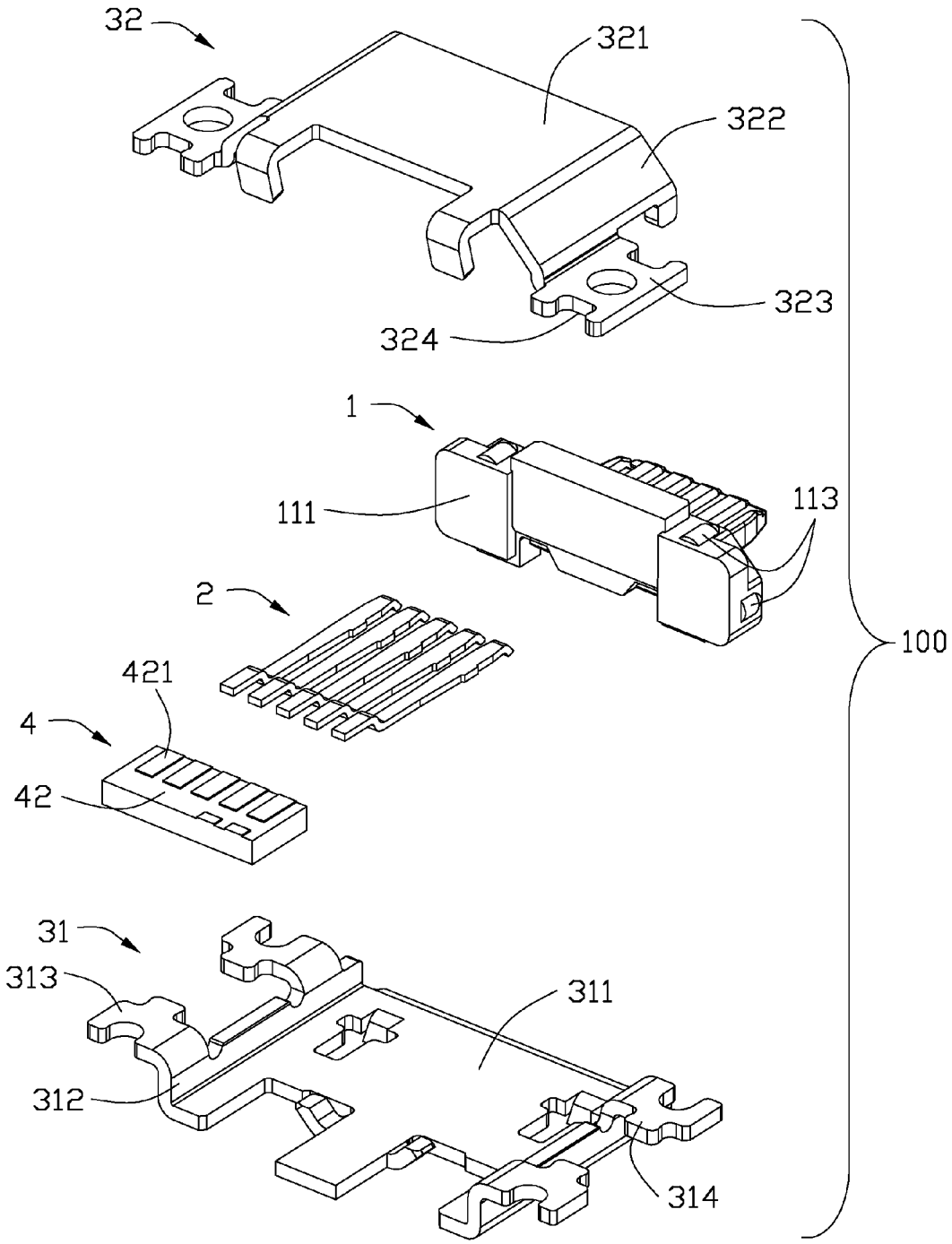
FIG. 4 is similar to FIG. 3, but viewed from another direction state.
Figure 5:
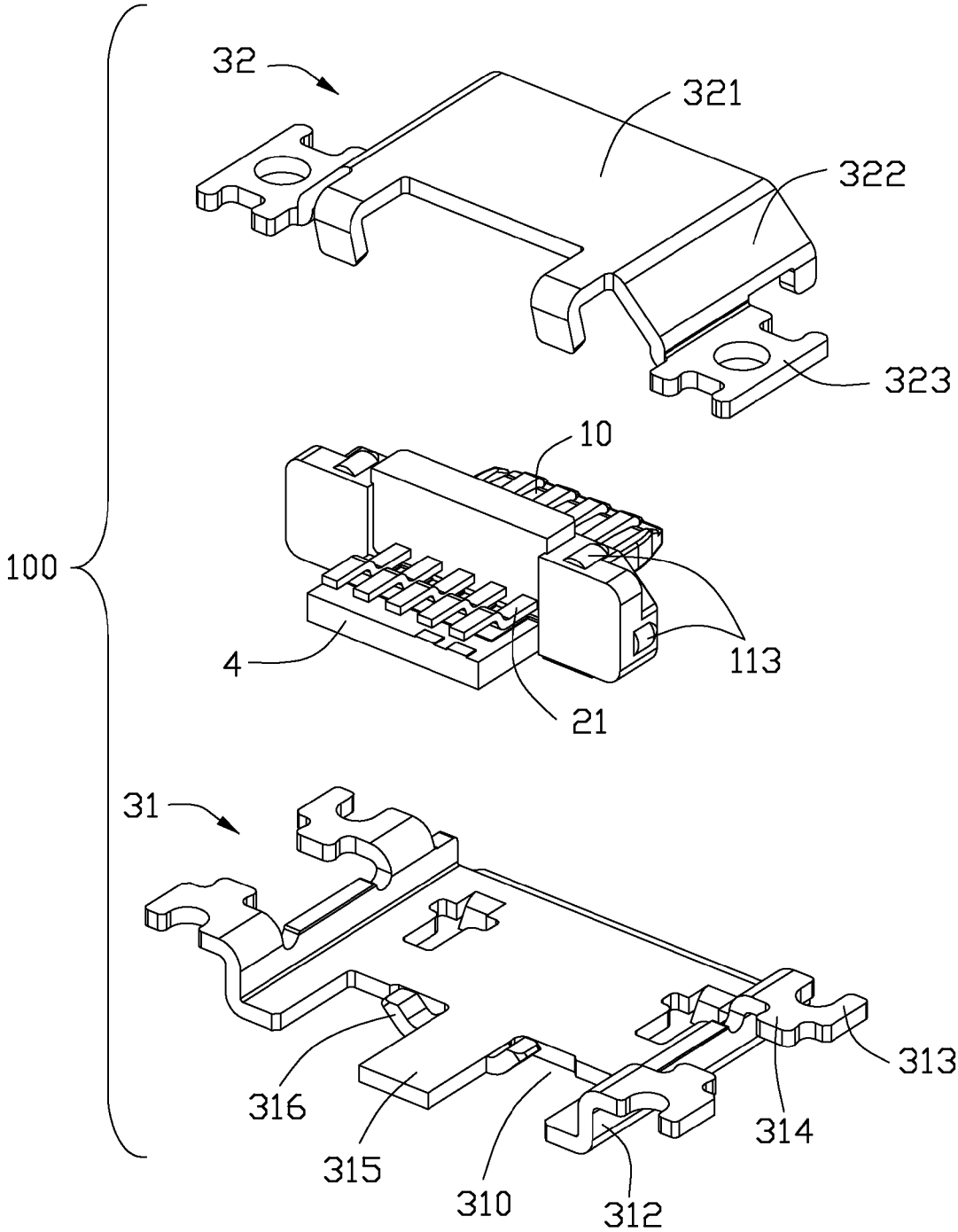
FIG. 5 is similar to FIG. 4, with several components pre-assembled.

Referring to FIGS. 1-5, an electrical connector assembly 100 with an integrated circuit module 4 is shown.

The electrical connector assembly 100 with an integrated circuit module 4 includes an insulative housing 1 having a plurality of recesses 10, a plurality of contacts 2 received in the recesses 10, and a shield case 3 enclosing the housing 1. The integrated circuit module 4 acts as an electrostatic discharge device.

The housing 1 has a base portion 11 and a tongue portion 12 extending forwardly from the base portion 11. The base portion 11 forms a pair of shoulder portions 111 grasping two opposite sides of the integrated module 4. A pair of square steps 112 projects from the base portion 11. A number of shafts 113 located in the base portion 11 leans against the shield case 3.

Each contact 2 includes a contact portion 21, a connecting portion 22, and a soldering portion 23 in sequence. The contact portion 21 has barbs 211 sticking into sides of the recesses 10.

The shield case 3 comprises a top shell 31 and an opposite bottom shell 32. The top shell 31 is made of a metal sheet and comprises a ceil 311, a pair of top lateral walls 312 extending from the ceil 311, and a pair of top flaps 313 extending from the lateral walls 312. The bottom shell 32 is also made of a metal sheet and comprises a ground 321, a pair of bottom lateral walls 322 and a pair of bottom flaps 323. The top shell 31 and the bottom shell 32 define a space for receiving the housing 1. One of the top flap 313 and the bottom flap 323 has dove-tail slots 324, the other one has blocks 314 inserting into the dove-tail slots 324. The top flap 313 and the bottom flap 323 coplanarly combine together to form a soldering pad 30. One of the two faces of the soldering pad defines a soldering face 301. The soldering face 301 is placed between the top shell 31 and the bottom shell 32. A square slot 310 receiving and mating with the square step 112 is defined by the top shell 31. The shield case 3 comprises an inserting opening 33 in a front end, and a plate 315 extending from the ceil 311 at a back end and located in a middle of the square slot 310.

The integrated circuit module 4 defines a direction of thickness in which the integrate circuit module 4 has a minimum dimension. The integrated circuit module 4 has a top face 41 and an opposite bottom face 42 perpendicular to the direction of thickness. Either the top face 41 or the bottom face 42 has a soldering region 421. The soldering region 421 is located between the top shell 31 and the bottom shell 32. The plate 315 extending from the ceil 311 presses a face opposite to the face having the soldering region 421, and the plate 315 branches out arms 316 leaning against a front end of the integrated circuit module 4.

In the assembling process, insert the contacts 2 into the recesses 10 of the housing 1 made in an injection molding process, then assemble the housing 1 in the shield case 3. At the same time, the square steps 112 are received in the square slot 310, and shafts 113 lean against the shield case 3, and the blocks 314 are received in the dove-tail slots 324, and the top flap 313 and the bottom flap 323 form the soldering pad 30. At last, insert the integrated circuit module 4 into the connector. The plate 315 presses a face of the integrated circuit module 4, the soldering portions 23 of contacts 2 are soldering to the soldering region 421, the arms 316 lean against the front end of the integrated circuit module 4, and the shoulders 111 grasp two opposite sides of the integrated circuit module 4. The soldering portions 23 of contacts are mounted on a first plane, and the integrated circuit module 4 is soldering to a second plane parallel to the first plane. The connecting portions 22 of the contacts 2 extend beyond the base portion 11 located at rear end of housing 1, a gap for receiving the integrated circuit module 4 is defined by the base portion 11, the plate 315 of the shield case 3 and the connecting portion 22 of the contacts 2. The plate 315 and the arms 316 form an anchor portion whose front end leans against the base portion 11 and rear end leans against the integrated circuit module 4.

Figure 6:
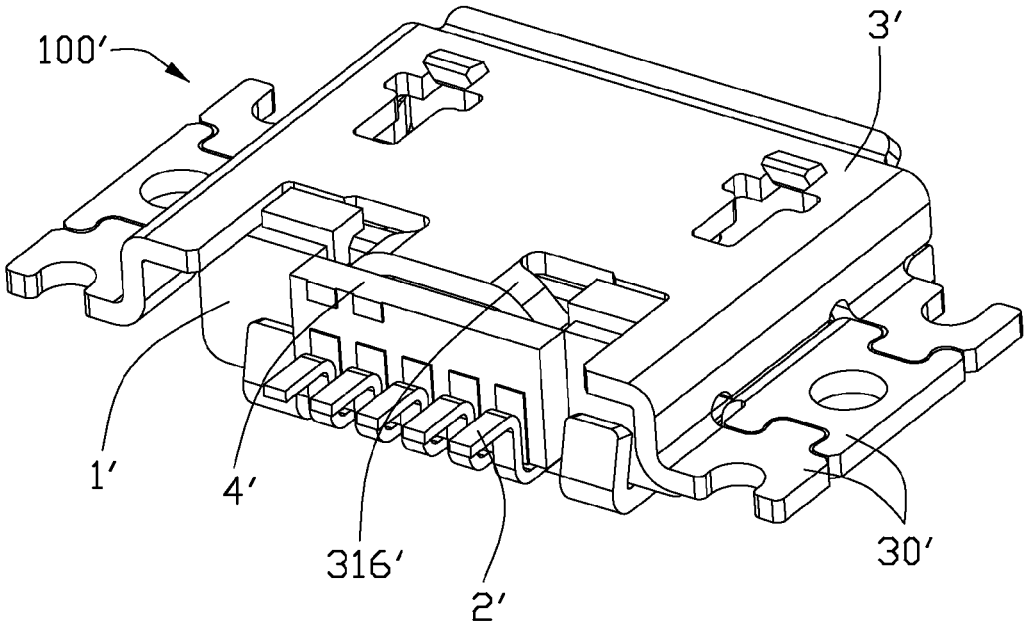
FIG. 6 is a perspective, assembled view of an electrical connector assembly of a second embodiment.
Figure 7:
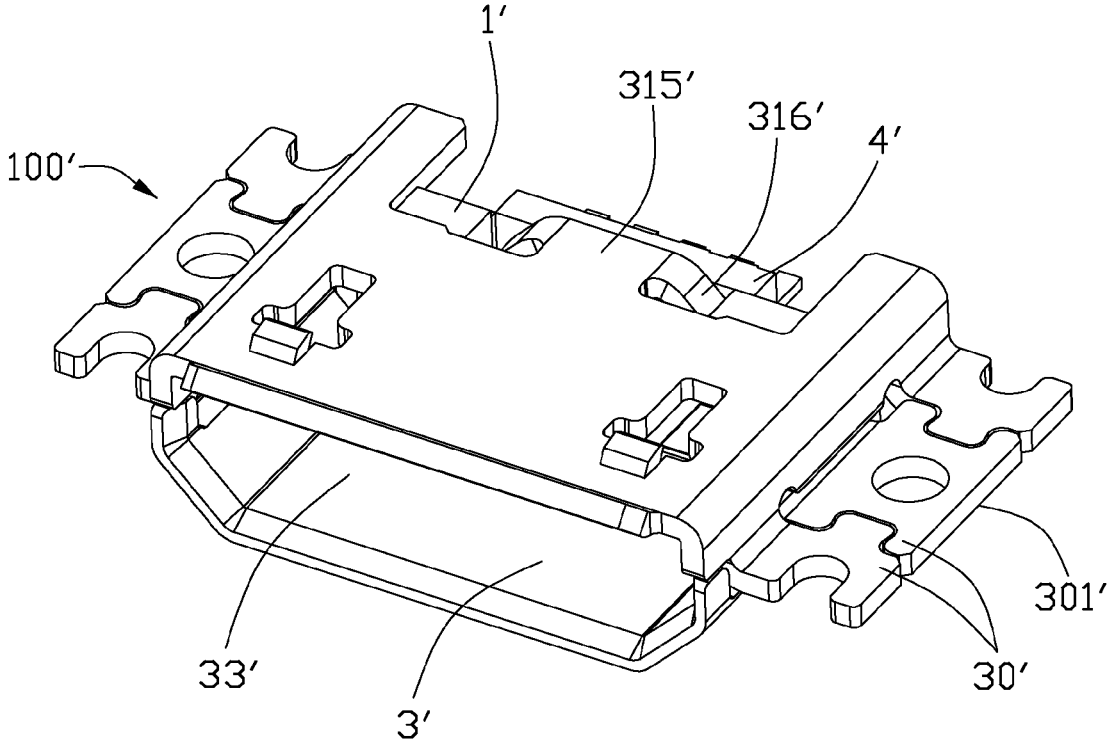
FIG. 7 is another perspective, assembled view of the electrical connector assembly of FIG. 6.
Figure 8:
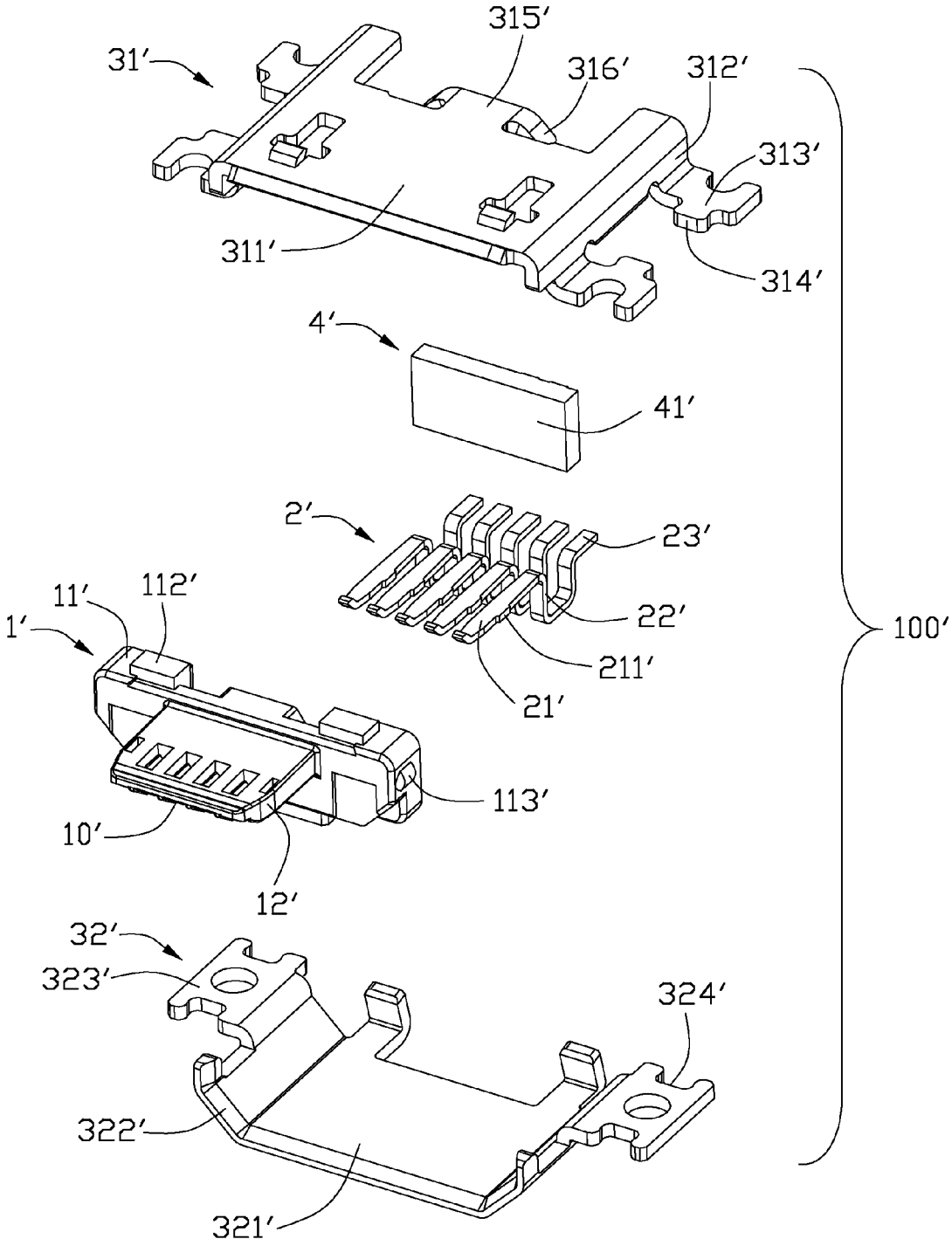
FIG. 8 is a perspective, exploded view of the electrical connector assembly.
Figure 9:
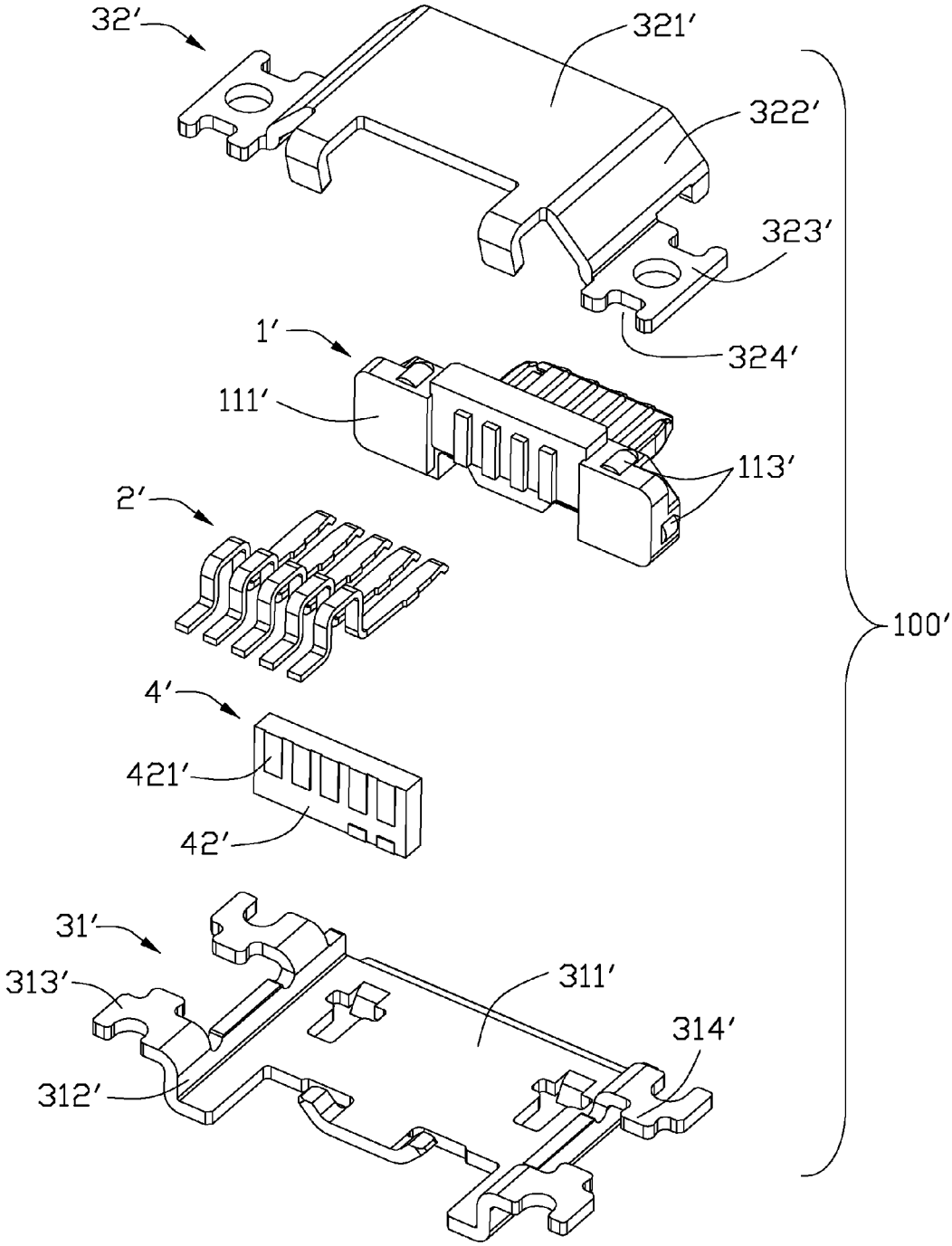
FIG. 9 is similar to FIG. 7, but viewed from another direction.
Figure 10:
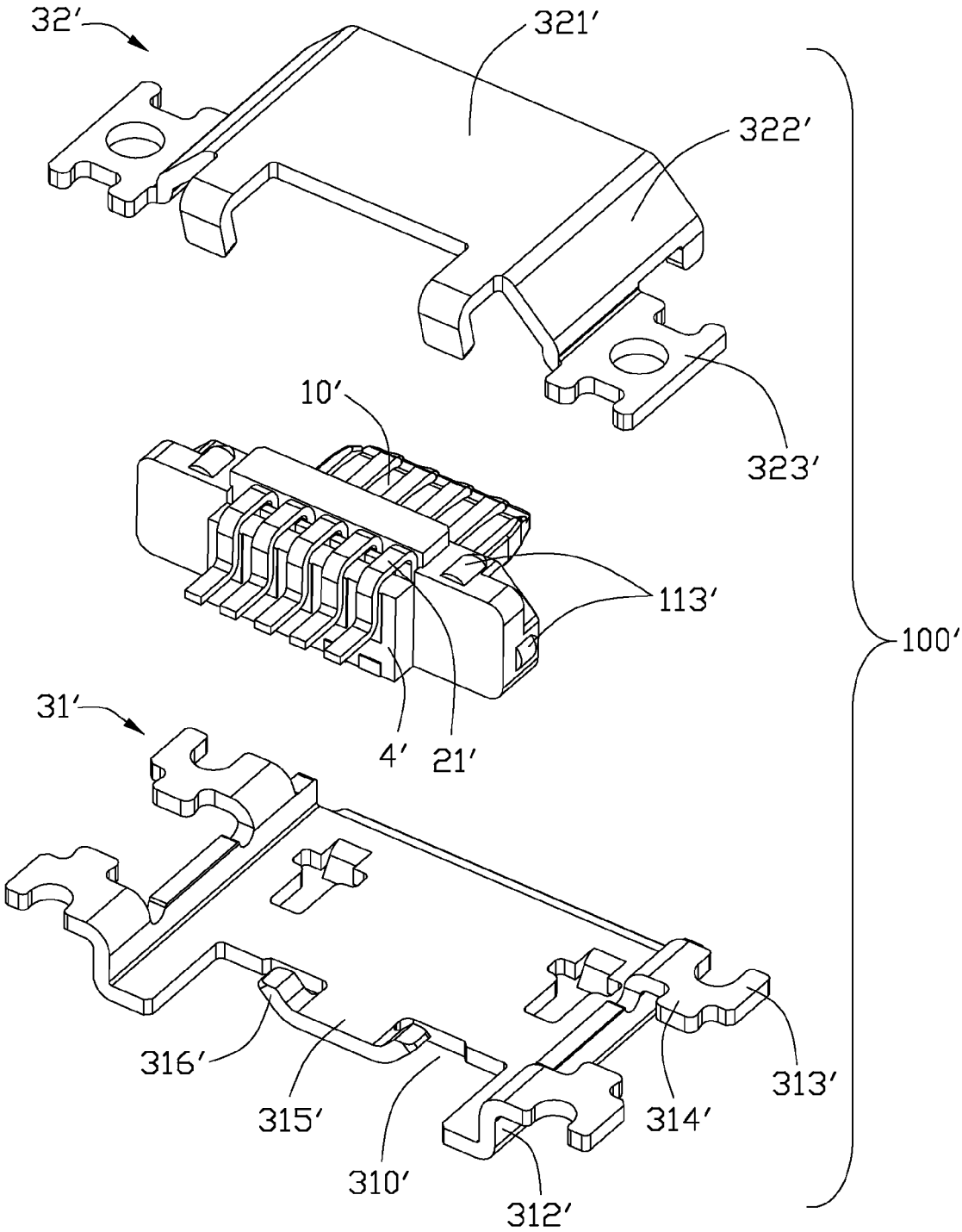
FIG. 10 is similar to FIG. 9, with several components pre-assembled.

Referring to FIGS. 6-10, a second embodiment of this invention is to be described.

An electrical connector assembly 100' with an integrated circuit module 4' includes an insulative housing 1' having a number of recesses 10', a number of contacts 2' are received in the recesses 10', and a shield case 3' enclosing the housing 1'. An integrated circuit module 4' acts as an electrostatic discharge device.

The housing 1' has a base portion 11' and a tongue portion 12' extending forwardly from the base portion 11'. The base portion 11 forms a pair of shoulder portions 111' grasping two opposite sides of the integrated module 4'. A pair of square steps 112' projects from the base portion 11'. A number of shafts 113' located in the base portion 11' leans against the shield case 3'.

Each contact 2' includes a contact portion 21', a connecting portion 22', and a soldering portion 23' in sequence. The contact portion 21' has barbs 211' sticking into sides of the recesses 10'. The connecting portion 22' forms to be U-shaped, and a side of the connecting portion 22' is attached to the integrated circuit module 4'.

The shield case 3' comprises a top shell 31' and an opposite bottom shell 32'. The top shell 31' is made of a metal sheet and comprises a ceil 311', a pair of top lateral walls 312' extending from the ceil 311', and a pair of top flaps 313' extending from the lateral walls 312'. The bottom shell 32' is also made of a metal sheet and comprises a ground 321', a pair of bottom lateral walls 322' and a pair of bottom flaps 323'. The top shell 31' and the bottom shell 32' define a space for receiving the housing 1'. One of the top flap 313' and the bottom flap 323' has dove-tail slots 324', the other one has blocks 314' inserting into the dove-tail slots 324'. The top flap 313' and the bottom flap 323' combine together to form a soldering pad 30'. One of the two faces of the soldering pad defines a soldering face 301'. The soldering face 301' is placed between the top shell 31' and the bottom shell 32'. A square slot 310' receiving and mating with the square step 112' is defined by the top shell 31'. The shield case 3' comprises an inserting opening 33' in a front end, and a plate 315' extending from the ceil 311' at a back end and located in a middle of the square slots 310'.

The integrated circuit module 4' defines a direction of thickness in which the integrate circuit module 4' has a minimum dimension. The integrated circuit module 4' has a top face 41' and an opposite bottom face 42' perpendicular to the direction of thickness. Either the top face 41' or the bottom face 42' has a soldering region 421'. The soldering region 421' is located between the top shell 31' and the bottom shell 32'. The plate 315' extending from the ceil 311' presses a face opposite to the face having the soldering region 421', and the plate 315' branches out arms 316' leaning against a front end of the integrated circuit module 4'.

In the assembling process, insert the contacts 2' into the recesses 10' of the housing 1' made in an injection molding process, then assemble the housing 1' in the shield case 3'. At the same time, the square steps 112' are received in the square slots 310', and shafts 113' lean against the shield case 3', and the blocks 314' are received in the dove-tail slots 324', and the top flap 313' and the bottom flap 323' form the soldering pad 30'. At last, insert the integrated circuit module 4' into the connector. The integrated circuit module 4' are hold by the U-shaped connecting portions 22' of the contacts 2', the soldering portions 23' of contacts 2' are soldering to the soldering region 421', the arms 316' lean against the front end of the integrated circuit module 4', and the shoulders 111' grasp two opposite sides of the integrated circuit module 4'. The soldering portions 23' of contacts are mounted on a first plane, and the integrated circuit module 4' is soldering to a second plane perpendicular to the first plane. The connecting portions 22' of the contacts 2' extend beyond the base portion 11' located at rear end of housing 1', a gap for receiving the integrated circuit module 4' is defined by the connecting portion 22' of the contacts 2'. The integrated circuit module 4' is inserted into the gap. The plate 315' and the arms 316' form an anchor portion whose front end leans against the base portion 11' and rear end leans against the integrated circuit module 4'.

In the first and the second embodiment of this invention, the integrated circuit module is inserted into a gap in order to keeping stable, and the gap is defined by the base portion 11, the plate 315 of the shield case 3 and the connecting portions 22 of the contacts 2 in the first embodiment while the gap is defined by the connecting portions 22' of the contacts. Both improve the stability of the integrated circuit module.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly for mating with a complementary connector, comprising:

an insulative housing having a base portion and a tongue portion extending from said base portion;

a plurality of contacts assembled in a plurality of recesses defined in the housing, each of said contacts having a front contact portion, a connecting portion adjacent to the contact portion, and a rear soldering tail adjoined to the connecting portion;

a shield case enclosing said housing; and an integrated circuit module;

wherein, said integrated circuit module is electrically connected to said connecting portions of the contacts and located between the soldering tails of the contacts and a rear side of the shield case;

wherein the shield case includes a top shell and a bottom shell, each of the top shell and the bottom shell having a lock portion interlocked with each other;

wherein the interlocked lock portions of the top shell and the bottom are coplanar;

wherein one of the top shell and the bottom shell defines a pair of slots, and the other one defines a pair of projections received in the slots.

2. The electrical connector assembly as described in claim 1, wherein said integrated circuit module extends in a direction parallel to an insertion direction of the complementary connector.

3. The electrical connector assembly as described in claim 2, wherein said shield case has a plate extending backwardly, and said integrated circuit module held by the plate and the connecting portions of the contacts.

4. The electrical connector assembly as described in claim 3, wherein said contact portions of the contacts are embedded in the tongue portion of the housing, and said connecting portions of the contacts extend rearwards beyond the base portion.

5. The electrical connector assembly as described in claim 1, wherein said integrated circuit module extends in a direction perpendicular to an insertion direction of the complementary connector.

6. The electrical connector assembly as described in claim 5, wherein said connecting portion of the contact is U-shaped and receives the integrate circuit module.

7. An electrical connector assembly comprising:

an insulative housing defining a vertical base with a horizontal mating tongue extending forwardly therefrom along a front-to-back direction;

a plurality of contacts disposed in the housing, each of said contacts defining a front contact portion exposed upon the mating tongue, a rear soldering portion exposed rearwardly behind the base, and a connecting portion located between the front contact portion and the rear soldering portion in said front-to-back direction; and upper and lower half shells respectively located upon an upper part and a lower part of the housing in a vertical direction perpendicular to said front-to-back direction, and commonly enclosing the housing, each of said upper half shell and said lower half shell defining mounting pads wherein the mounting pads define a mounting plane coplanar with the soldering portions of the contacts for mounting to a printed circuit board; wherein an integrated circuit board is assembled to the connection portions under an arrangement that when the integrated circuit board is assembled in a horizontal manner relative to the housing, the integrated circuit board is essentially located above the mounting plane; alternately, when the integrated circuit board is assembled in a vertical manner relative to the housing, said integrated circuit board downwardly extends below the mounting plane.

8. The electrical connector assembly as claimed in claim 7, wherein one of said upper and lower half shells includes two of said mounting pads and the other includes one of said mounting pads sandwiched between said two of the mounting pads in the front-to-back direction in a coplanar manner.

9. The electrical connector assembly as claimed in claim 7, wherein when the integrated circuit board is assembled in the vertical manner relative to the housing, a front face of the integrated circuit board abuts against the upper half shell for positioning while a rear face of the integrated circuit board electrically connect to the corresponding connection portions, respectively.

10. The electrical connector assembly as claimed in claim 7, wherein the mounting plane is essentially located at a mid-level of said housing.

11. The electrical connector assembly as claimed in claim 7, wherein when said integrated circuit board is assembled in the vertical manner relative to the housing, the connection portion defines an upside-down U-shaped configuration to grasp an upper part of the integrated circuit board.

12. The electrical connector assembly as claimed in claim 11, wherein when the integrated circuit board is assembled in said vertical manner relative to the housing, a vertical dimension of the integrated circuit board is similar to that of the vertical base.

13. The electrical connector assembly as claimed in claim 7, wherein when the integrated circuit board is assembled in the horizontal manner relative to the housing, the integrated circuit board is sandwiched between the connection portions of the contacts and the upper half shell in said vertical direction.

14. The electrical connector assembly as claimed in claim 13, wherein when said integrated circuit board is assembled in the horizontal manner relative to the housing, a front edge of the integrated circuit board abuts against the upper half shell for positioning.

15. An electrical connector assembly comprising:

an insulative housing including a vertical base and a horizontal mating tongue extending forwardly from the base;

a plurality of contacts disposed in the housing, each of said contacts defining a front contact portion exposed upon the mating tongue, a rear soldering portion exposed rearwardly behind the base, and a connecting portion located between the front contact portion and the rear soldering portion in said front-to-back direction;

upper and lower half shells respectively located upon an upper part and a lower part of the housing in a vertical direction perpendicular to said front-to-back direction, and commonly enclosing the housing, each of said upper half shell and said lower half shell defining mounting pads wherein the mounting pads define a mounting plane coplanar with the soldering portions of the contacts for mounting to a printed circuit board, said upper half shell defining an anchor portion; and an integrated circuit board assembled to the connection portions; wherein a front face of said anchor portion confronts the base and a rear face of said anchor portion confronts the integrated circuit board in said front-to-back direction.

16. The electrical connector assembly as claimed in claim 15, wherein when said integrated circuit board is assembled in a vertical manner relative to the housing, a front face of the integrated circuit board abuts against the rear face of the anchor portion; when said integrated circuit board is assembled in a horizontal manner relative to the housing, a front edge of the integrated circuit board abuts against the rear face of the anchor portion.

17. The electrical connector assembly as claimed in claim 16, wherein said anchor portion includes an arm extending toward the mating tongue in the vertical direction, and both said front face and said rear face of the anchor portion are formed on the arm.

* * * * *